US006088964A

United States Patent [19]

Scherrer

[11] Patent Number: 6,088,964

[45] Date of Patent: Jul. 18, 2000

[54] DOOR LIFTER

[75] Inventor: Kurt Scherrer, Munsingen, Switzerland

[73] Assignee: USM U. Scharer Sohne AG, Munsingen, Switzerland

[21] Appl. No.: 09/168,156

[22] Filed: Oct. 8, 1998

[30] Foreign Application Priority Data

Oct. 8, 1997 [EP] European Pat. Off. ..... 97810754

[51] Int. Cl.[7] ..... E05F 11/00

[52] U.S. Cl. ..... 49/200; 160/191

[58] Field of Search ..... 49/197, 199, 200, 49/203; 160/210, 190, 189, 191, 192

[56] References Cited

U.S. PATENT DOCUMENTS

| | | | |
|---|---|---|---|
| 2,024,724 | 12/1935 | Eager et al. | 49/203 |
| 3,429,072 | 2/1969 | Sammons | 49/203 |
| 3,552,475 | 1/1971 | Fehr | 160/189 X |
| 3,902,220 | 9/1975 | Little . | |
| 4,018,005 | 4/1977 | Harrip | 49/199 |
| 4,516,813 | 5/1985 | Sekerich . | |
| 4,658,473 | 4/1987 | Schema . | |

FOREIGN PATENT DOCUMENTS

| | | | |
|---|---|---|---|
| 2529250 | 12/1983 | France | 49/197 |
| 1584178 | 11/1969 | Germany . | |
| 2106614 | 8/1972 | Germany . | |
| 2456094 | 8/1976 | Germany . | |
| 093017210 | 9/1993 | WIPO | 49/203 |

*Primary Examiner*—Jerry Redman

[57] ABSTRACT

A device for opening or lifting a door (22) that hangs down by a hinge (23) with a horizontal swivel axis is characterized by an elbow lever mechanism, which is operated by means of a spring element (21) and which can additionally be folded down in the area of its dead point when the door (22) is still hanging or which is at its maximum force transfer when the door (22) is swivelled up. The door should preferably also be able to be folded down.

12 Claims, 4 Drawing Sheets

DOOR LIFTER

TECHNICAL BACKGROUND

The invention concerns a device for opening or lifting a door that hangs down by a hinge with a horizontal swivel axis, comprising an elbow lever mechanism with two jointly connected legs, of which one is formed by a rotatable lever element for contacting the door, and a guide lever on which grips the spring element for operating the elbow lever mechanism.

STATE OF THE ART

Furniture systems are structured in a way so that they can be adapted to the most varied requirements (spatial, user technical, etc.). Cupboard elements, for example, should be capable of being mounted according to need, not only at a reduced to medium height but also at a great height, wherein each one of the cupboard doors should be comfortable to operate. Swivel doors are advantageous to keep elements that are set in higher locations easily accessible, where these doors are rotatably hung on the swivel axis of the upper edge of the element. That is, in the closed condition, the door hangs essentially vertically down so that it must be swung up to open. A door lifter is installed to ensure that, on the one hand, the door can be opened without great effort and, on the other hand, it can remain in the open position without the user's help.

Door lifters can be obtained in the market, which operate by means of a gas pressure cylinder. The limited maximum pull-out speed is characteristic of these cylinders. Also, even in the case of carelessness, the danger of injury during mounting or use is negligible. This is an advantage with respect to a steel spring, which has no inherent movement attenuation.

Shear elements and hinges operated or supported by springs are known in great numbers. However, they are not constructed for doors that hang by a top hinge and which are to be swivelled from an essentially vertical position to an essentially horizontal position.

From a purely technical point of view, the gas pressure cylinder, however, is inferior to a steel spring. Not only is the average service life of a gas pressure cylinder somewhat shorter than that of a steel spring, but it is also more expensive to discard.

A hinge for a door trap that hangs down when closed and stands out horizontally when open is already known from U.S. Pat. No. 4,516,813. Moreover, the trap can be folded down and be held and guided by means of a jointed square: the arms (58, 60) are fixedly positioned at the points (56, 57) and guide with their ends (47, 48), the angle lever (43), which supports the door. The angle lever (43), which supports the door, is not rotatable around a fixed mechanical axis, but it is displaced in space and rotated by means of two short swivel arms (58, 60). A leaf spring (63) that runs more or less parallel alongside both short swivel arms is provided for balancing the movement and grips directly onto the end of the angle lever (43) that supports the door. If the door hangs down, the elbow lever mechanism forms a typical 90° angle for maximum force transfer (compare with, for example, FIG. 5). In the known construction, the spring element (21) also grips onto the angle lever (43). A disadvantage of this known mechanism consists in that it is relatively small and correspondingly sensitive to disturbances. The force development also does not correspond to the modern comfort requirements.

DE-OS 2,106,614 shows an elbow lever hinge, wherein the arm that supports the door has on its rear end a column guide (32) with a shorter and a longer curve path (33, 34). A spring-supported arm (7) is displaceably installed in the longitudinal column (32). When opening or closing the trap door, the spring-supported arm (7) jumps from one column section into the other. It is obvious that the back and forth jumping generates an uncomfortable unstable force development.

Another spring-attenuated hinge is known from, for example, DE 1,584,178. A curve surface (11) is provided herein, which is formed on one of the two elbow levers in the area of the elbow lever (9) and which rolls off on the guide bolts (12, 13). In the closed position (FIG. 1 of DE 1,584,178, not FIG. 2 as is cited erroneously on paragraph 2, page 4), the spring (4) is tensed and blocked by means of the guide bolts (12, 13). In the open position (FIG. 2, not FIG. 1 as cited erroneously in paragraph 2, page 4), the elbow lever is extended, whereby the pressure spring is again blocked by a bolt (12, 16). The joint mechanism forms a jointed square precisely defined by the axes 8, 9, 17, and 3 (compare with FIG. 2). The door lies horizontally on the container to be closed when in the closed condition and stands up vertically when open. The elbow joint (5/10) is extended when the door is open (that is, at its dead point). The maximum force transfer of the elbow lever is reached at an approximate 45° position of the door. This mechanism is not suitable for guiding a door of the kind described above.

The hinge according to DE-PS 1,584,178 is a further embodiment of the hinge described in the earlier patent DE-PS 1,035,011 (compare with page 1, paragraph 1, of DE-PS 1,584,178). DE-PS 1,035,011 describes a hinge for a freezer or the like. The basic function is similar to the one in DE 1,584,178. Contrary to the later application, in the earlier patent publication DE-PS 1,035,011, the elbow joint is guided by means of a longitudinal column guide and not by means of an outer curve surface formed on the elbow lever. This hinge also is not suitable for operating door traps of the kind described above.

DESCRIPTION OF THE INVENTION

The object of the invention is to provide a device of the kind described above, which on the one hand avoids the disadvantages of the known door lifters and, on the other hand does not only have an adapted force development (so that the door cannot open or close in an uncontrolled manner), but also has a compact structure.

According to the present invention, the construction of the door lifter is distinguished by an elbow lever mechanism, which is in the region of the dead point when the door is closed and at its maximum force transfer when the door is open. A spring (for example, a spiral spring) is provided as a drive or force element.

The elbow lever ensures a measured transfer of the spring force. When the door is closed, the spring is tensed, but the elbow lever located at or near the dead point prevents the force from leading to an extension. When opening the door, the elbow lever comes after a short movement out of its dead point and effects an increasing torque with an increasing opening angle. The lever conditions can be set in this way to ensure that the torque exerted by the door lifter is only slightly greater than the counteracting torque of the door. In the course of a 90° swivel movement, the door can consequently not be accelerated (even if left to itself) to a high rotational speed.

According to a preferred embodiment, the mechanism is structured so that one of the legs of the elbow lever is formed on a lever element, which contacts the door for opening the door. The lever element is thereby rotatably installed at a point, which is at a determined distance from the swivel axis of the door.

The contact point (between lever and door) and the joint point (of the elbow joint) are displaced from each other by an angle of, for example, approximately 90°, depending upon the rotation point of the lever.

The second leg of the elbow lever can be attached by the joints with its free (rear) end to a one-arm guide lever. That is, a joint square is formed, which has a corner that can fold inward (in the area of the dead point of the elbow lever).

The pressure spring that operates the elbow lever mechanism (for example, a compressed spiral spring) attaches to the guide lever according to a particularly preferred embodiment. It is, however, also feasible to provide a spring that grips onto another area of the elbow lever mechanism. It could attach particularly directly onto the second leg or be arranged in an extension of the same.

It is advantageous if the elbow lever mechanism and the pressure spring are installed in a narrow flat square frame. This frame is formed, for example, by two punched plates, which are connected to each other by means of gap elements. The frame is preferably shaped symmetrically. The door lifter arrangement is then side independent; that is, it can be mounted either on the right or left side of the door.

The movable parts of the mechanism can, of course, be installed on a frame that is open to only one side or directly on the wall element. The device does not need to be constructed completely symmetrically. The construction is preferably selected in such a way that it is independent of the side at least from the operational point of view.

With respect to a safe and undisturbed operation of the door lifter, the pressure spring should always be within the frame so that it cannot be obstructed or blocked during opening or closing by objects that accidentally get in the way. Only the operating arm that contacts the door should project out of the flat frame.

According to a particularly preferred embodiment, the elbow lever passes over the dead point shortly before reaching the closed position. A stop element can be provided to ensure that the elbow joint of the elbow lever takes on a defined position when the door is closed, that is, in the area opposite the dead point. The same can be, for example, a plastic element that is integrated into the flat frame at a suitable location.

A stop should also ensure that the door takes on a defined position when it is closed. This stop is preferably also formed on the frame of the door lifter and grips, for example, onto a second leg of the elbow lever. Another possibility is that, for example, a lifting limit is provided at the spiral spring.

The door lifter according to the invention is particularly suitable for cupboard elements that are placed at a higher location. The door, for example, is hung by a separate swivel bearing and is opened by the door lifter. The swivel axis of the door will not coincide with the rotation point of the lever that makes pressure on the door in the normal case, but will have a certain eccentricity with respect to the lever rotation point. A slide contact, for example, can be provided between door lifter and door so that this eccentricity of the opening and closing movements is not impaired.

According to a particularly preferred embodiment, the door lifter (and therefore the rotation point of the operating lever in question) is fixed, and the swivel axis of the door instead is displaceable. During opening, the bearing of the door is displaced up to a required point. The swivel bearing of the door is displaceably installed on a horizontally displaceable slide, so that the whole door can be folded down into the cupboard element (or a correspondingly provided shaft) after opening.

The fold-down door has, for example, a coupling piece wherein a corresponding piece of the operating lever can grip during the opening and closing movement. The coupling is structured in such a manner that the pieces can detach from each other when the door is folded down without the use of force. The coupling between the door lifter and the door makes it possible to pull the door into the desired closed position when closing. That is, it can transfer not only pressure but also a pulling force.

The coupling piece formed on the door lifter offers a stop for the coupling piece of the door, so that when the door is opened, the same is necessarily pulled into the cupboard element to a certain extent shortly before reaching the horizontally projecting position. In this slightly folded-down position, the door is secured better against an undesirable overrotation ("crash protection").

From the following detailed description and the totality of the claims result further advantageous embodiments and feature combinations of the invention.

BRIEF DESCRIPTION OF THE DRAWINGS

The drawings are used to illustrate the embodiments, wherein.

All the figures are basically provided with the same numerals for the same elements.

DESCRIPTION OF THE PREFERRED EMBODIMENTS OF THE INVENTION

Figure 1:
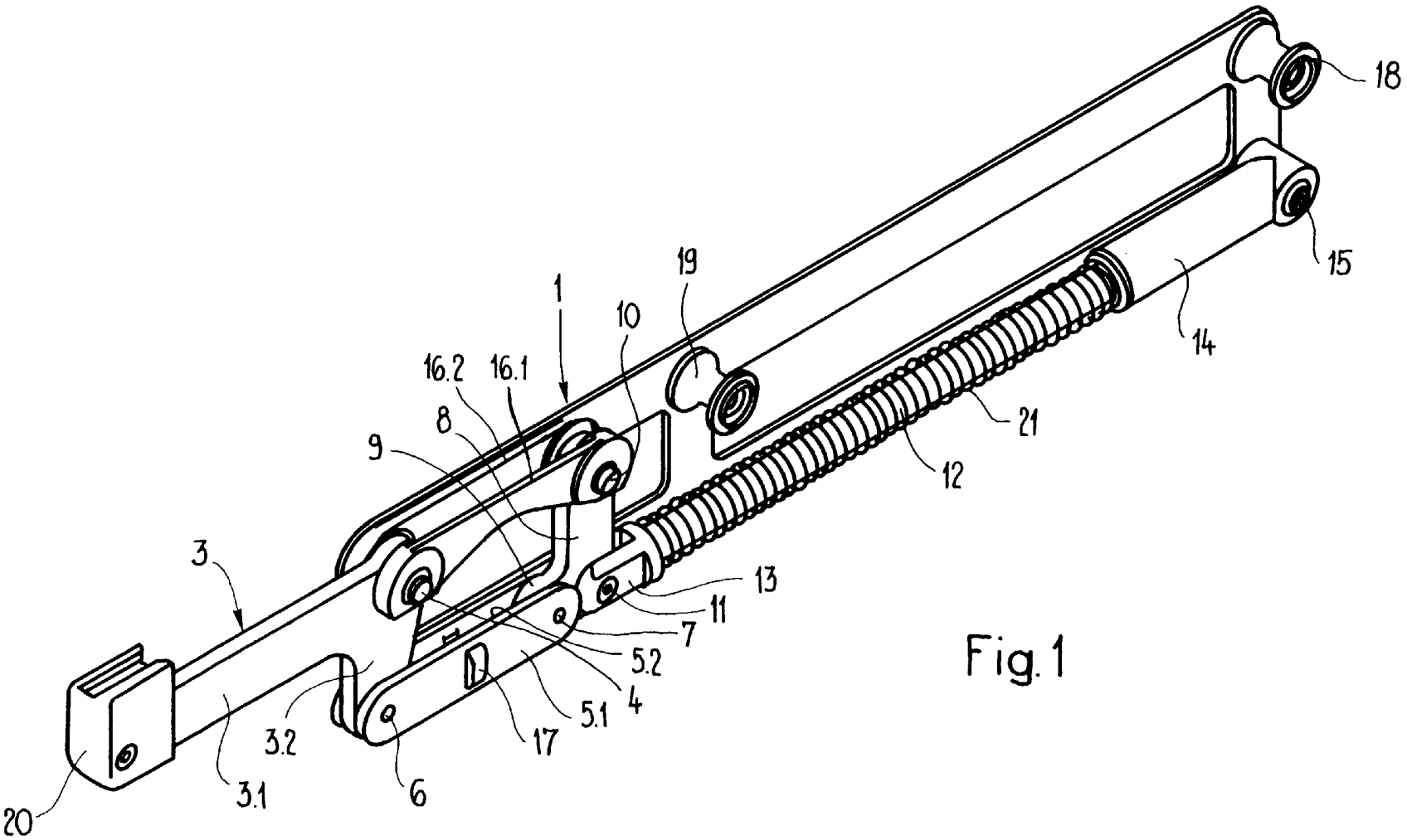
FIG. 1 shows a schematic perspective representation of a door lifter according to the invention.

FIG. 1 shows a particularly preferred embodiment of the invention. The movable parts are installed within a frame formed essentially by means of two side parts 1, 2. Only the side part 1 is represented in FIG. 1. The second part (which can be seen in FIG. 2*b*) was left out to make visible the elbow lever mechanism.

The side parts 1, 2 are built identically. They are elongated, rectangular, flat steel plate elements, which are removed (for example, punched) out of areas that are not relevant to the stability. The height, for example, amounts to approximately ⅕ to ⅙ of the length.

An axis 4 is arranged on the front end of the frame (in FIG. 1 in the front upper corner), which on the one hand connects together both side parts 1, 2 at a desired distance and, on the other hand, bears an L-shaped operating lever 3. In the door lifter's open position (that is, horizontally projecting open door), the long leg 3.1 of the operating lever 3 projects horizontally forward into an extension of the upper edge of the frame (side parts 1, 2). A coupling piece 20 is attached at its end. The short leg 3.2 forms an angle of approximately less than 90° with the long leg. According to FIG. 1, it projects downward in the open position. Its length corresponds approximately to the height of the frame.

Two strip-shaped flat elements 5.1, 5.2 are attached at the joints by their first ends with an axis 6 at the end of the short leg 3.2. The flat elements 5.1, 5.2 are attached at the joints to a bent arm 9 of a guide lever 8 at the other end with the aid of another axis 7. The L-shaped guide lever 8 is installed at the end of its long leg in the axis 10 so that it can be swivelled at the side parts 1, 2.

A forked head 13 of a rod 12 grips onto the elbow of the L-shaped guide lever 8. The connection between the forked head 13 and the guide lever 8 is shaped as a joint (axis 11). The rod 12 is displaceably arranged with its rear end in a tube 14. The tube 14 itself can be attached to the axis 15 in a swivel manner. A spiral spring 21 is located on the rod 12, which pushes the forked head 13 (and therefore the rod 12) forward, that is, out of the tube 14.

Two stop elements 16.1, 16.2 extend between the axes 4 and 10. They can be, for example, plastic strip-shaped parts.

Other stop elements are formed at the flat elements 5.1, 5.2. FIG. 1 shows a cam 17 that serves as stop element in a manner still to be described. A second similar cam is formed at the flat element 5.2. Said stop elements are provided on the outer sides of the flat elements 5.1, 5.2 (that is, on the surfaces facing the side parts 1, 2 of the flat elements). At a corresponding point of the inner side of the side parts 1, 2 are arranged corresponding stop elements (not shown). In the open position of the door lifter, the so-called stop elements ensure that the operating lever 3 takes on a defined position.

Both side parts 1, 2 are not only connected by means of the axes 4, 10, 15, but also by means of the gap holders 18, 19. There is a connection between the side parts 1, 2 at least at three of the comers of the frame.

Figure 2B:
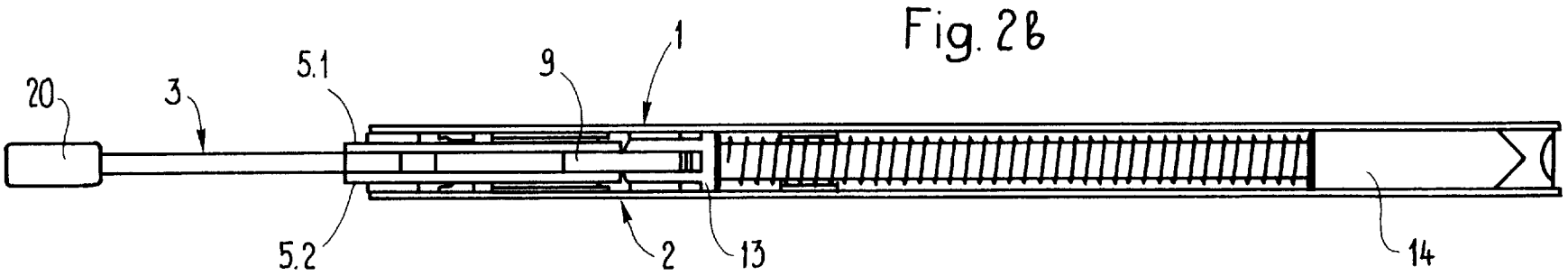
FIGS. 2*a, b* show a door lifter according to FIG. 1 seen from the side and from below.
Figure 2A:
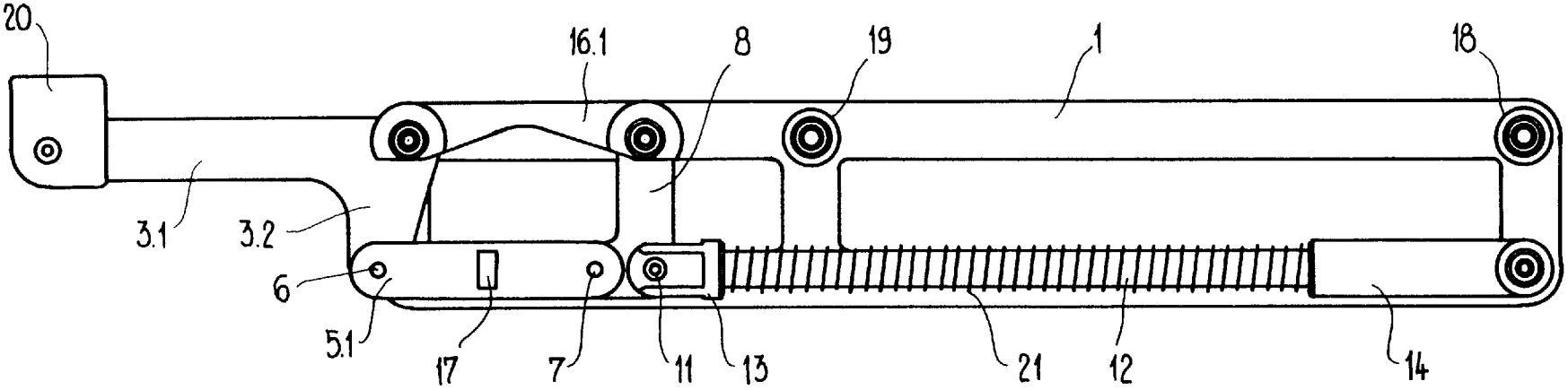

FIG. 2*b* clearly shows the symmetric construction according to the invention with respect to the center plane of the frame (that is, the geometric plane that runs parallel to the flat side parts 1, 2 and which stands in the center of the same). The mutual gap of the side parts 1, 2 is selected as small as possible. The named gap corresponds to the sum of the thickness of the following elements: operating lever 3, flat elements 5.1 and 5.2, stop elements 16.1 and 16.2.

Figure 3A:
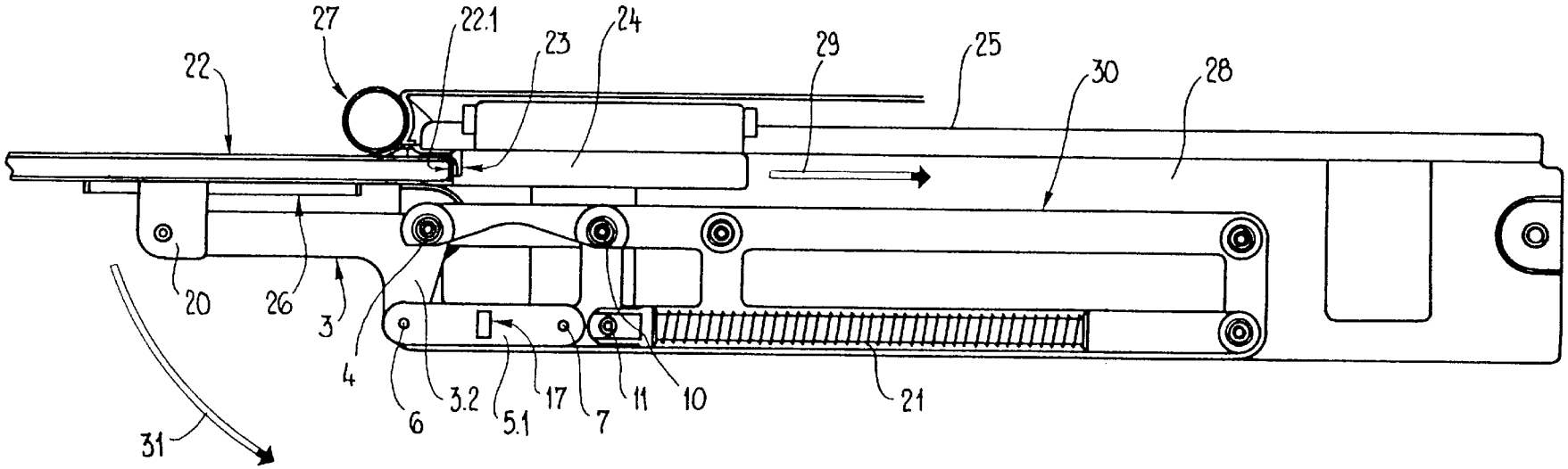
FIGS. 3*a, b* show the door lifter mounted in a cupboard element in the open or closed position.
Figure 3B:
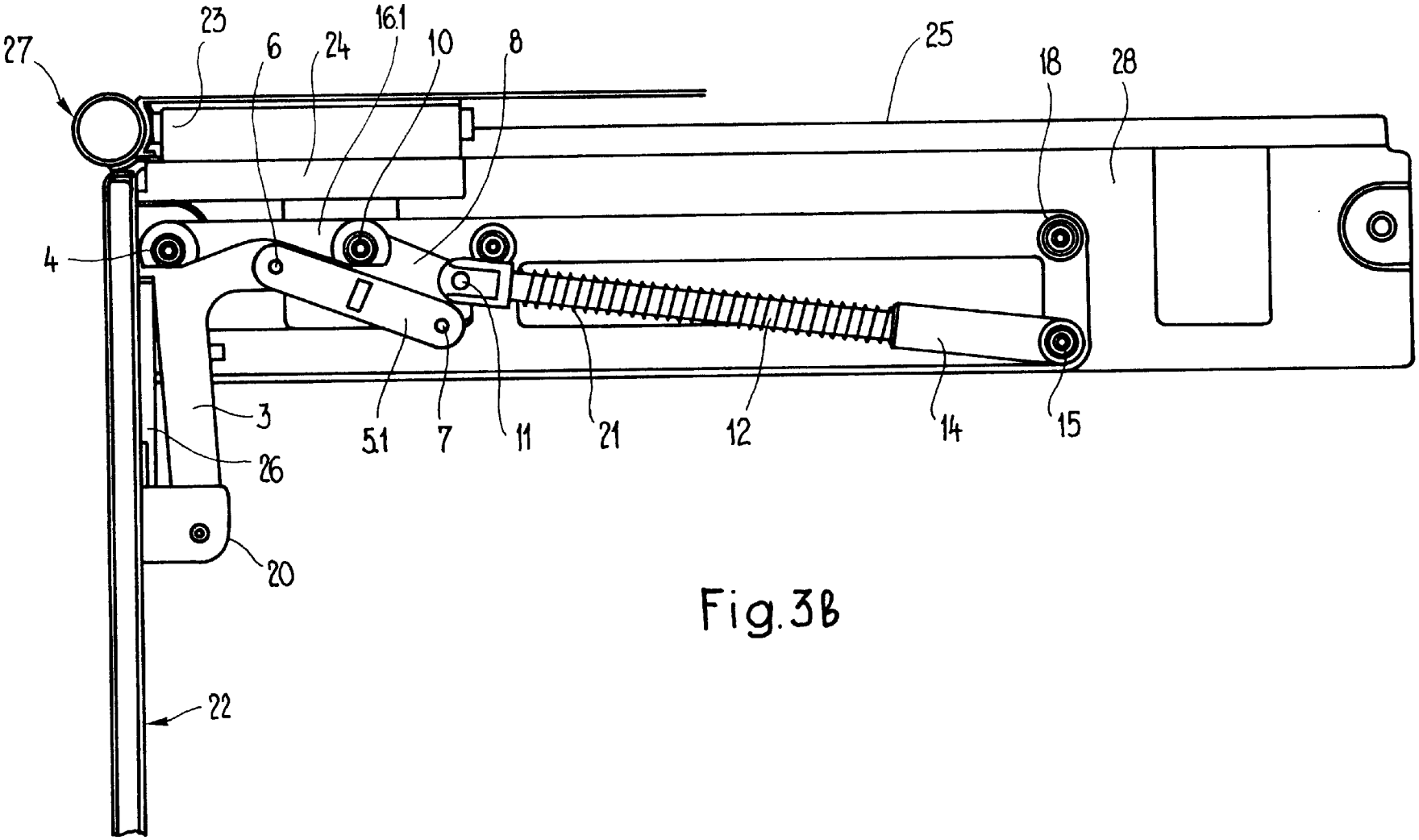

FIGS. 3*a* and 3*b* show the door lifter of FIG. 1 as mounted, for example, in a cupboard element. The front side part 2 is left out again to expose the view of the elbow lever mechanism. A door 22 is hung by a hinge 23 by means of a horizontally running rotation axis. The rotation axis stands vertical to the drawing plane in the representation according to FIGS. 3*a, b*. The door 22 can be swivelled from a vertically hanging position (FIG. 3*b*) into a horizontally projecting position (FIG. 3*a*). In this example, the plate-shaped door 22 is connected to the upper edge 22.1 by a hinge 23. The hinge 23 sits on a slide 24, which can be displaced into the cupboard element along a track 25 toward the rear in the direction of the arrow 29. The track 25 is formed on a side carrier 28, which serves at the same time as an attachment for the door lifter 30. FIGS. 3*a, b* allude to a frame tube 27, which is part of the cupboard element and which forms the upper edge of the cupboard opening. (Other not represented frame tubes delimit the named opening at the remaining three edges).

A coupling piece 26 is arranged on the inside of the door 22, which can grip into the coupling piece 20 of the door lifter.

The operation of the door lifter 30 shall be described in the following.

In the open position according to FIG. 3*a,* the door 22 can be folded down into the cupboard element in the direction of the arrow 29 (that is, into the intermediate space between the track 25 and the door lifter 30 that extends toward the rear parallel to the track 25). When folding down, the coupling pieces 20 and 26 are released from each other. The door 22 is supported by the door lifter and slides thereby with its inner side toward the coupling piece 20. The sliding friction is relatively small, so that the door 22 can be folded down without a particular effort.

In the horizontal position according to FIG. 3*a,* the door 22 is held by means of the operating lever 3, which is pushed by means of the spiral spring 21 into the open position. The rod 12 and the flat elements 5.1, 5.2 (FIGS. 3*a, b* only show flat element 5.1) are therefore on a straight line. This line is parallel to an imaginary connecting line between the axes 4 and 10. The elbow lever, which is formed on the one hand by the flat elements 5.1, 5.2 and, on the other hand by the leg 3.2, is located at a position of maximum force transfer.

To close the door 22, the user pushes downward, whereby the door swivels around the hinge 23 in the direction of the arrow 21. The movement forced by the user rotates the operating lever 3 around the axis 4. The flat elements 5.1, 5.2 and the rod 12 are correspondingly pushed in the direction of their longitudinal axis to the rear. The spiral spring 21, which holds the weight of the door 22, is then compressed.

With decreasing opening angle, the force transfer rate of the elbow lever becomes smaller. Then, even though the spiral spring 21 increases the pressure during compression, the total force applied on the door 22 by means of the operating lever 3 decreases. This decrease of the force corresponds to the torque, which is generated by the weight of the door itself (with respect to the axis of the hinge 23) and which decreases with a decreasing opening angle. As a consequence, the user has the sensation that the door 22 is balanced. Depending upon the need, the lever conditions in the door lifter can be selected so that the door has the tendency to move toward the open or closed position.

FIG. 3*b* shows the closed position. The elbow joint (compare with axis 6) of the elbow lever (or particularly the flat elements 5.1, 5.2) lies (or lie) on the stop elements 16.1, 16.2. The joint is located at the dead point, which has as a consequence that the pressure of the spiral spring 21 does no longer push the door to the outside, but pulls the same into the closed position. In this connection, it must be taken into consideration that the pulling shut of the door 22 is made possible by means of the coupling pieces 20 and 26. The same are shaped in such a manner that the door 22 and the operating lever 3 remain firmly coupled during the swivel movement.

The dead point is intersected, for example, by an opening angle of 5° to 10°, that is, by an angle wherein the torque caused by the weight of the door itself is relatively small. It must be noted, however, that the door already effects a minimum torque on the lever mechanism at dead point and that the force development of the spring that sets in is stopped in this way.

As can be seen in FIG. 3*b,* when the door level is closed the flat elements 5.1, 5.2 lie when the door lever is closed essentially parallel to the guide lever 8. The rod 12 and the guide lever 8 form an angle of approximately 180°. An imaginary extension of the rod 12 goes essentially through the axis 4. The axis 10 lies slightly over an imaginary connection line between the axis 11 and the axis 4. If the triangle formed by the axes 4, 7, and 6 is observed and compared to the one formed by the axes 10, 11, and 15, it can be established that they are directed toward each other. In other words, in the triangle 4/7/6, the comer opposite to the base side 4/7 is located on the opposite side of the side facing the triangle 10/11/15. Along these lines, in the triangle 10/11/15, the corner (11) opposite the bottom side 10/15 is located on the side facing the triangle 4/7/6.

The advantage of this construction is that no separate device must be provided to hold the door closed (against the force of the door lifter).

In FIG. 3*a* can also bc seen that the length of the flat element 5.1, 5.2 (or the gap between the axes 6, 7) is slightly smaller (for example approx. 10%) than the opposite gap between the axes 4 and 10. Additionally, the gap between the axes 6 and 11 in the open position of the door lifter is greater (for example approx. 10%) than the opposite gap between the axes 4 and 10.

The coupling pieces 20, 26, for example, can be pushed one into the other in the direction of the arrow 29 according to the groove-spring principle (that is, parallel to the door).

Another characteristic of the embodiment shown consists in that the door 22 is already slightly folded in when it reaches the open position. That is, the axis of the hinge 23 is no longer in the same place with an open door 22 as with a closed door 22. Instead, it is displaced to the rear in the direction of the arrow 29. This has the advantage that the hinge 23 is secured against overrotating ("crash protection"). The door 22 stands at the edge tube 27 and therefore cannot be swivelled up passed the horizontal position. The resulting blocking is more reliable the farther the contact point is between the door 22 and the frame tube 27 of the axis of the hinge 23.

The pushing back of the door 22 is connected with the fact that, on the one hand, there is a gap between the axis 4 of the operating lever 3 and the axis of the hinge 23 and, on the other hand, the coupling pieces 20, 26 are shaped in such a way that the door 22, when swiveling, cannot be pushed passed a certain position determined by the geometry of the closed door 22.

How far the door 22 can be pulled out of the folded-down position is not determined by the front end position of the slide 24 on the track 25, but rather by means of the coupling piece 20, wherein the coupling piece 26 is pushed. Only if the door 22 is swivelled down at a determined angle is the slide 24 on the front stop (end position).

The invention is naturally not limited to the described embodiment. Some variation possibilities will be indicated briefly in the following.

The door does not need to be able to fold down. It is perfectly possible that it can be fixedly connected to an operating lever of the door lifter. The swivel axis of the door is then the axis of the operating lever. It can also be based upon a fixed hinge that is independent from the door lifter, whereby the contact location can be displaced between the operating lever and the door.

The elbow lever can be built in such a manner that it can be located exactly at the dead point in the closed position. However, it is in no way excluded that the dead point cannot even be reached. That is, the spring will be able to exert a constant opening pressure on the door. A rest fastener can be provided on the cupboard element to be able to hold the door nonetheless in the closed position.

The selection of the lever conditions is determined according to the individual case in dependence upon the weight of the door and the geometric guidelines.

The exemplary embodiment shows a construction characterized by a reduced construction height. For other applications it may be desirable, among other things, to provide a door lifter with a reduced depth. It is easily distinguishable that the shown construction can be turned by almost 90° into a vertical position, whereby the operating lever, for example, must be structured in a different way. A single-arm lever can be provided, instead of the L-shaped lever (that is, the leg 3.2 serves at the same time as contact element to the door).

The swivel axis of the door must not necessarily be provided at the upper edge of the door leaf. The door can be mounted projecting upward without problem.

The invention can be used everywhere where it is sought to bring a door from a vertical hanging position to a more or less horizontal projecting position.

Summarizing, it is determined that the door lifter according to the invention is constructed of robust and long-lasting elements and is suitable due to its compact construction for cupboards with inserts (tracks for pull drawers, shelves, etc.).

What is claimed is:

1. A pivoting mechanism for pivoting a door between a first substantially open position and a second substantially closed position, comprising:

an elbow lever mechanism comprising at least one leg member;

a lever element for contacting the door, said at least one leg member of said elbow lever mechanism having a first end pivotably connected;

a guide lever, said at least one leg member having a second end pivotably connected to said guide lever; and a spring element engaged with said guide lever and constructed and arranged to operate said elbow lever mechanism;

wherein said guide lever is connected with said at least one leg member such that when the door is closed, said elbow lever mechanism is at or adjacent to a dead point, and such that when the door is open, said elbow lever mechanism is in a state of maximum force transfer.

2. The mechanism according to claim 1, wherein said lever element includes first and second legs, with said first leg being shorter than said second leg.

3. The mechanism according to claim 1, wherein said spring element and said elbow lever mechanism are located within a frame comprising first and second generally parallel and spaced apart frame members.

4. The mechanism according to claim 3, wherein said spring element comprises a spiral spring member wound about a rod member, wherein said spring member is provided within said frame.

5. The mechanism according to claim 3, further comprising a stop member provided on said frame for restraining movement of said elbow lever mechanism when the door is being closed.

6. A door assembly movable between a first substantially open position and a second substantially closed position, comprising:

a door; and a pivoting mechanism for said door, said pivoting mechanism comprising:

an elbow lever mechanism comprising at least one leg member;

a lever element for contacting said door, said at least one leg member of said elbow lever mechanism having a first end pivotably connected to said lever element;

a guide lever, said at least one leg member having a second end pivotably connected to said guide lever; and a spring element engaged with said guide lever and constructed and arranged to operate said elbow lever mechanism;

wherein said guide lever is connected with said at least one leg member such that when said door is in the closed position, said elbow lever mechanism is at or adjacent to a dead point, and such that when said door is in the open position, said elbow lever mechanism is in a state of maximum force transfer.

7. The door assembly according to claim 6, comprising a swivel bearing connected to said door, said swivel bearing being displaceable along a track.

8. The door assembly according to claim 7, wherein said track is aligned with the open position of said door such that said door is movable between an extended position and a retracted position in a direction lying in the plane of said door.

9. The door assembly according to claim 8, comprising a coupling member provided on said door, said coupling member being constructed and arranged to engage a portion of said lever element when said door is the open and extended position.

10. The door assembly according to claim 9, wherein said engagement between said coupling member and said portion of said lever element for contacting said door when said door is in the open position prevents overrotation of said door beyond the open position with respect to a rotational direction from the closed position to the open position.

11. The door assembly according to claim 9, wherein said coupling member is constructed and arranged to allow said portion of said lever element to move relative to said coupling member when said door is moved between the open and extended position and the closed position.

12. The door assembly according to claim 8, comprising a coupling member provided on said door, said coupling member being constructed and arranged to be disengaged from said portion of said lever element when said door is in an open and retracted position.

* * * * *